US007156459B2

(12) United States Patent
Ambasz

(10) Patent No.: US 7,156,459 B2
(45) Date of Patent: Jan. 2, 2007

(54) STACKABLE CHAIR

(75) Inventor: Emilio Ambasz, Buenos Aires (AR)

(73) Assignee: Center for Design Research and Development N.V. c/o Open Ark B.V., Amsterdam (NL)

( * ) Notice: Subject to any disclaimer, the term of this patent is extended or adjusted under 35 U.S.C. 154(b) by 378 days.

(21) Appl. No.: 10/688,175

(22) Filed: Oct. 17, 2003

(65) Prior Publication Data

US 2004/0104608 A1 Jun. 3, 2004

(51) Int. Cl.
*A47C 3/04* (2006.01)

(52) U.S. Cl. ..... 297/239; 297/56; 297/299; 297/447.1; 297/404; 297/354.11; 297/38; 297/126; 297/16.1; 297/411.31; 297/411.38

(58) Field of Classification Search ..... 297/16.1, 297/50, 56, 291, 299, 301.5, 447.1, 296, 297/297, 404, 354.11, 36, 38, 116, 115, 171, 297/173, 411.31, 411.37, 411.38, 411.35
See application file for complete search history.

(56) References Cited

U.S. PATENT DOCUMENTS

| | | | | |
|---|---|---|---|---|
| 947,090 | A * | 1/1910 | Wolfe | 297/50 |
| 2,466,553 | A * | 4/1949 | McDonald | 297/404 |
| 2,973,029 | A * | 2/1961 | Schlosstein | 297/216.12 |
| 5,904,397 | A * | 5/1999 | Fismen | 297/291 |
| 6,017,091 | A * | 1/2000 | Cao | 297/411.37 |
| 6,022,079 | A * | 2/2000 | Bergsten et al. | 297/411.35 |
| 6,502,904 | B1 * | 1/2003 | Hansen | 297/411.35 |
| 6,540,300 | B1 * | 4/2003 | Piretti | 297/411.35 |

FOREIGN PATENT DOCUMENTS

| | | |
|---|---|---|
| CA | 2316368 | 5/2000 |
| EP | 1060695 | 12/2000 |
| WO | 0024294 | 5/2000 |

* cited by examiner

*Primary Examiner*—Laurie K. Cranmer
(74) *Attorney, Agent, or Firm*—Baker Botts LLP

(57) ABSTRACT

A stackable chair has a backrest mounted on back supports by resilient mount units for tilting between an upright position and a tilted-back position. Each mount unit includes a rigid coupling member having a lower portion received within an upper end portion of the respective back support and pivotally joined to the respective back support and having an upper portion received within and affixed to a socket in the backrest. A compression spring received within the upper end portion of the back support and engaged between the lower portion of the coupling member and a front wall of the respective back support biases the backrest to the upright position. An armrest is slidably supported on an armrest support for simultaneous and controlled pivotal movement about a substantially vertical pivot axis of a rearward part of the armrest relative to a forward part of the armrest and translatory movement in a plane perpendicular to the pivot axis. Movements of the armrests permit dense stacking of the chairs.

19 Claims, 11 Drawing Sheets

STACKABLE CHAIR

FIELD OF THE INVENTION

The present invention relates to stackable chairs of the type commonly used in commercial and institutional settings, such as in meeting and conference rooms, auditoriums, multi-purpose assembly halls, gymnasiums temporarily converted to auditoriums, and the like. Stackable chairs can be arranged in various ways to suit the specific needs for the use of a room on a case-by-case basis, are easily stacked when not needed, and occupy a small volume for storage.

BACKGROUND INFORMATION

The inventor of the present invention has previously invented several chairs of the general type to which the present invention relates. One feature of those prior chairs is the provision of a backrest that tilts rearwardly from an upright position, in which it is normally held by spring-biased backrest mount mechanisms. One may refer, for example, to Ambasz European Patent Application No. EP 1 060 695 A2 (Dec. 20, 2000) for a description and drawings of a stackable chair having a tiltable backrest. Such chairs allow a user to change his or her position from upright to leaning back, which makes them more comfortable than chairs with fixed backrests.

Stackable institutional chairs often have ganging fittings, connectors that permit the chairs to be joined together side by side. When the chairs have armrests, the provision of ganging fittings, which protrude from the sides of the chairs, prevents dense stacking the chairs, inasmuch as the arms of a lower chair will not allow the ganging fittings of an upper chair to pass. Ambasz Published International Application No. WO 00/24294 (Oct. 22, 1999) reveals one solution to that problem—the armrest is mounted so that it can be pivoted outwardly from a use position to a storage position in which the arm allows the ganging fitting to pass downwardly.

SUMMARY OF THE INVENTION

An object of the present invention is to provide a stackable chair that is comfortable to sit on, attractive in appearance, highly durable, versatile in use, and economical to produce. A further object is to provide a stackable chair that uses a relative small number of parts, can be readily mass-produced, and can be quickly and easily assembled by unskilled assemblers using simple tools.

The foregoing objects are attained, in accordance with the present invention, by a stackable chair that has a frame that includes legs and a pair of spaced-apart tubular back supports, a seat bottom mounted on the legs, and a backrest mounted on the back supports by resilient mount units for tilting between an upright position and a tilted-back position. The chair of the present invention is characterized in that each mount unit includes a rigid coupling member having a lower portion received within an upper end portion of the respective back support and pivotally joined to the respective back support and having an upper portion received within and affixed to a socket in the backrest and in that each mount unit further includes a compression spring received within the upper end portion of the back support and engaged between the lower portion of the coupling member and a front wall of the respective back support so as to bias the backrest to the upright position.

The advantages of the mount unit include strength and durability, concealment of all of the parts within the tubular back support and the socket of the backrest, the relatively small number of parts, the simplicity, and the ease of manufacture and assembly.

In preferred constructions, the lower portion of the coupling member of each mount unit includes a cavity in which a portion of the compression spring is received. The compression spring carries a low-friction pad that is engaged between the spring and the front wall of the back support. The foregoing features ensure retention of the spring in the proper position, resistance to wear, and smooth, quiet operation.

The coupling member of each mount unit may be pivotally joined to the respective back support by a pivot pin that passes through a hole in the coupling member and holes in walls of the back support. Advantageously, the lower portion of the coupling member of each mount includes a rear stop surface that engages a portion of the wall of the back support when the backrest is in the upright position and a front stop surface that engages a portion of the wall of the backrest support when the backrest is in the tilted-back position.

It is common practice in the industry for a manufacturer to offer essentially the same basic chair with various options, such as the addition of armrest supports associated with the frame and armrests mounted on the armrest supports. According to another aspect of the present invention, the stackable chair is characterized in that the armrest is slidably supported on the armrest support for simultaneous and controlled pivotal movement about a substantially vertical pivot axis of a rearward part of the armrest relative to a forward part of the armrest and translatory movement in a plane perpendicular to the pivot axis.

The ability of the armrest to be moved allows the armrest to normally reside in a use position in which it is relatively close to the side of the user's torso and a storage position in which it is shifted outwardly so that it will allow a ganging fitting of an upper chair of a stack to pass downwardly by the armrest of a lower chair of the stack.

In advantageous constructions, the armrest is biased to a use position and is pivotable and translatable against the bias to a storage position. When the armrest is in the use position, the rearward part of the armrest is closer to the center of the seat bottom than it is when the armrest is in the storage position. The armrest support may have a substantially flat support surface, and the arm rest may be mounted on the armrest support for pivotal movement by a pivot pin that is affixed to the armrest support, the pivot pin being received in an elongated slot in the armrest so that the armrest is able to translate relative to the armrest support. Controlled movement of the armrest may be enabled by a motion control slot in the armrest and a control pin affixed to the armrest support and received in the motion control slot. The motion control slot is configured to control the extent and path of movement of the armrest relative to the armrest support. Preferably, the motion control slot is shaped and located such that the armrest is selectively retained in the use position and the storage position under the bias of the spring.

For a better understanding of the invention, reference may be made to the following description of an exemplary embodiment, taken in conjunction with the accompanying drawings.

DETAILED DESCRIPTION

Figure 1:
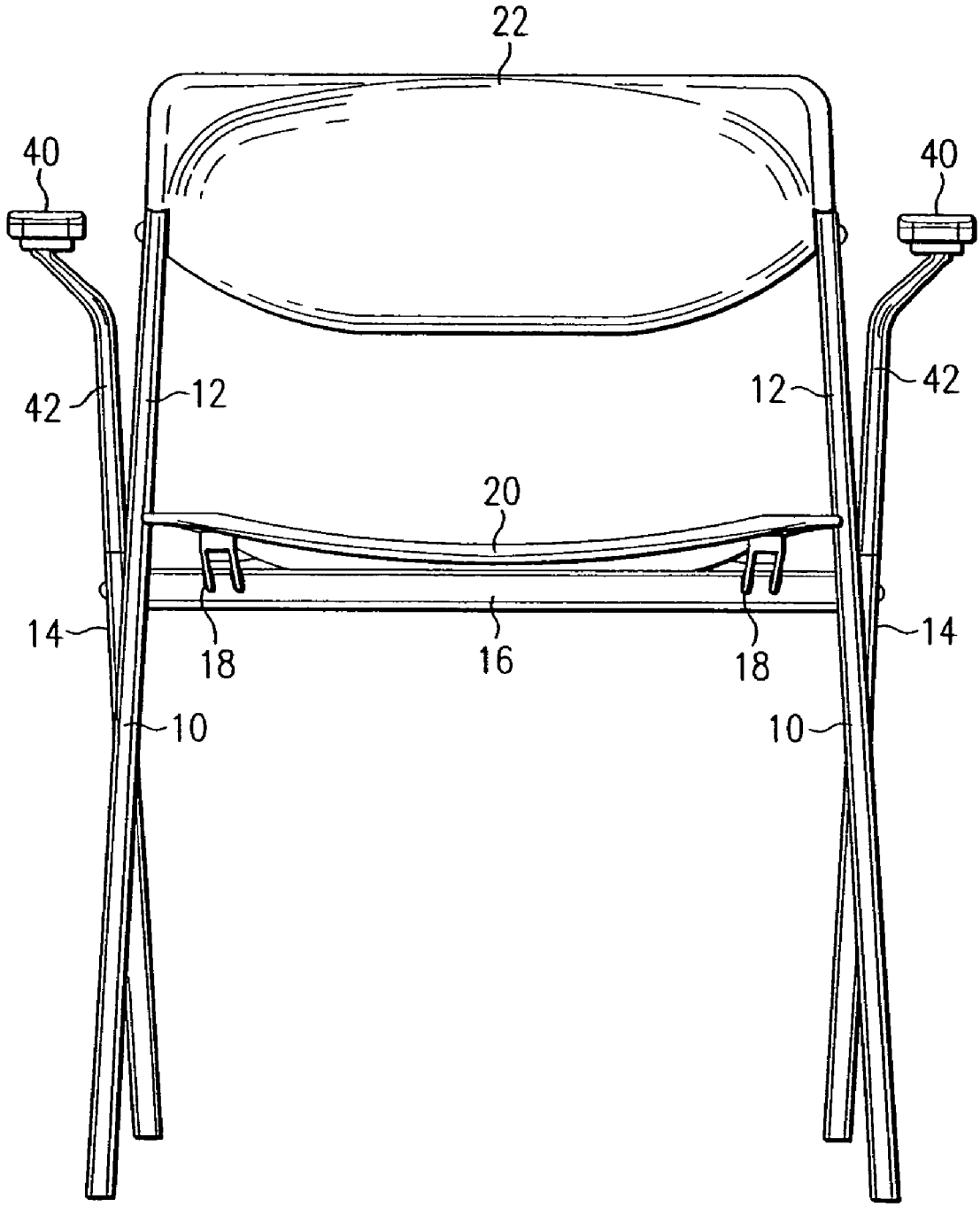
FIG. 1 is a front pictorial plan view of the embodiment.
Figure 2:
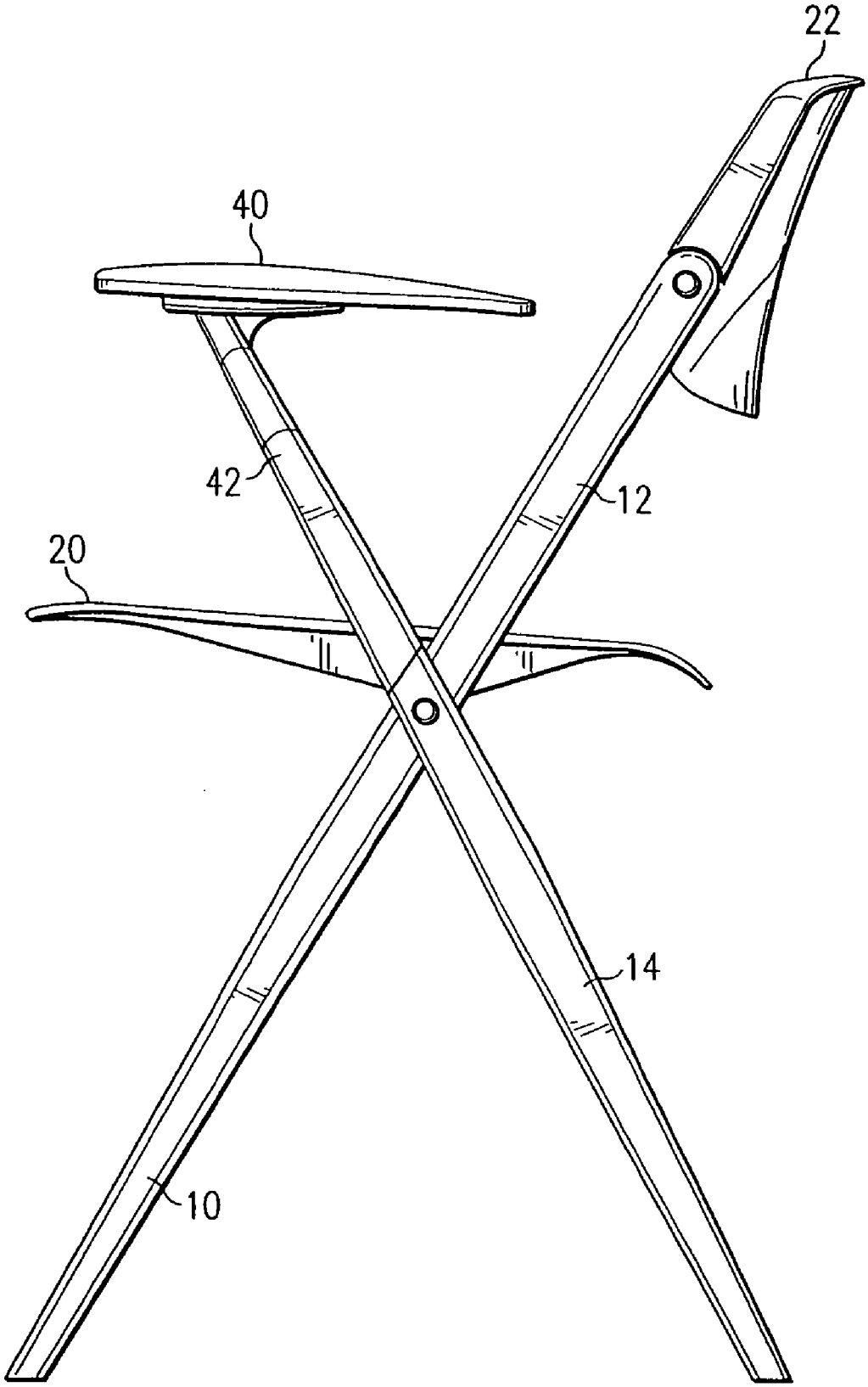
FIG. 2 is a side pictorial view of the embodiment.
Figure 3:
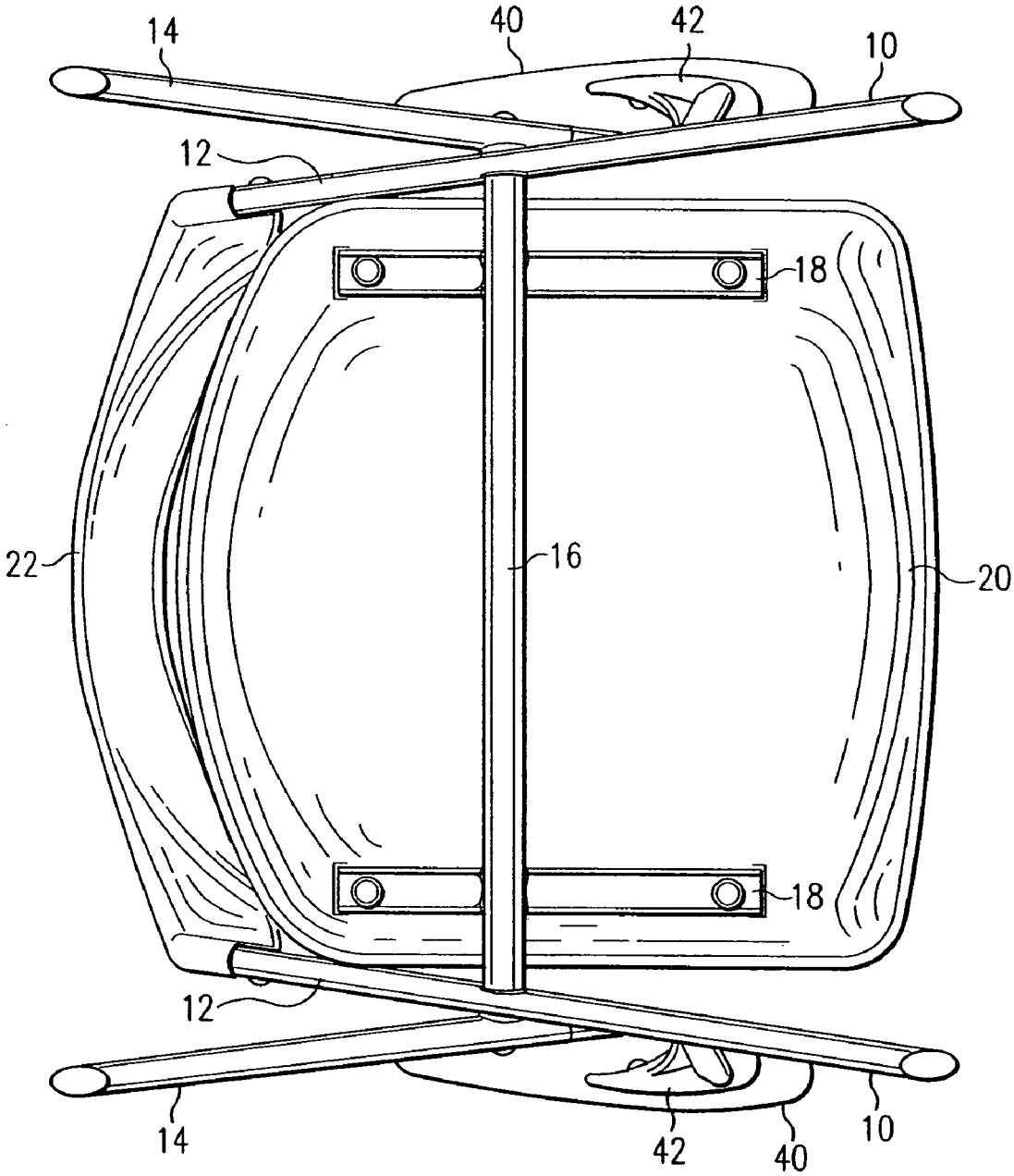
FIG. 3 is a bottom pictorial view of the embodiment.
Figure 4:
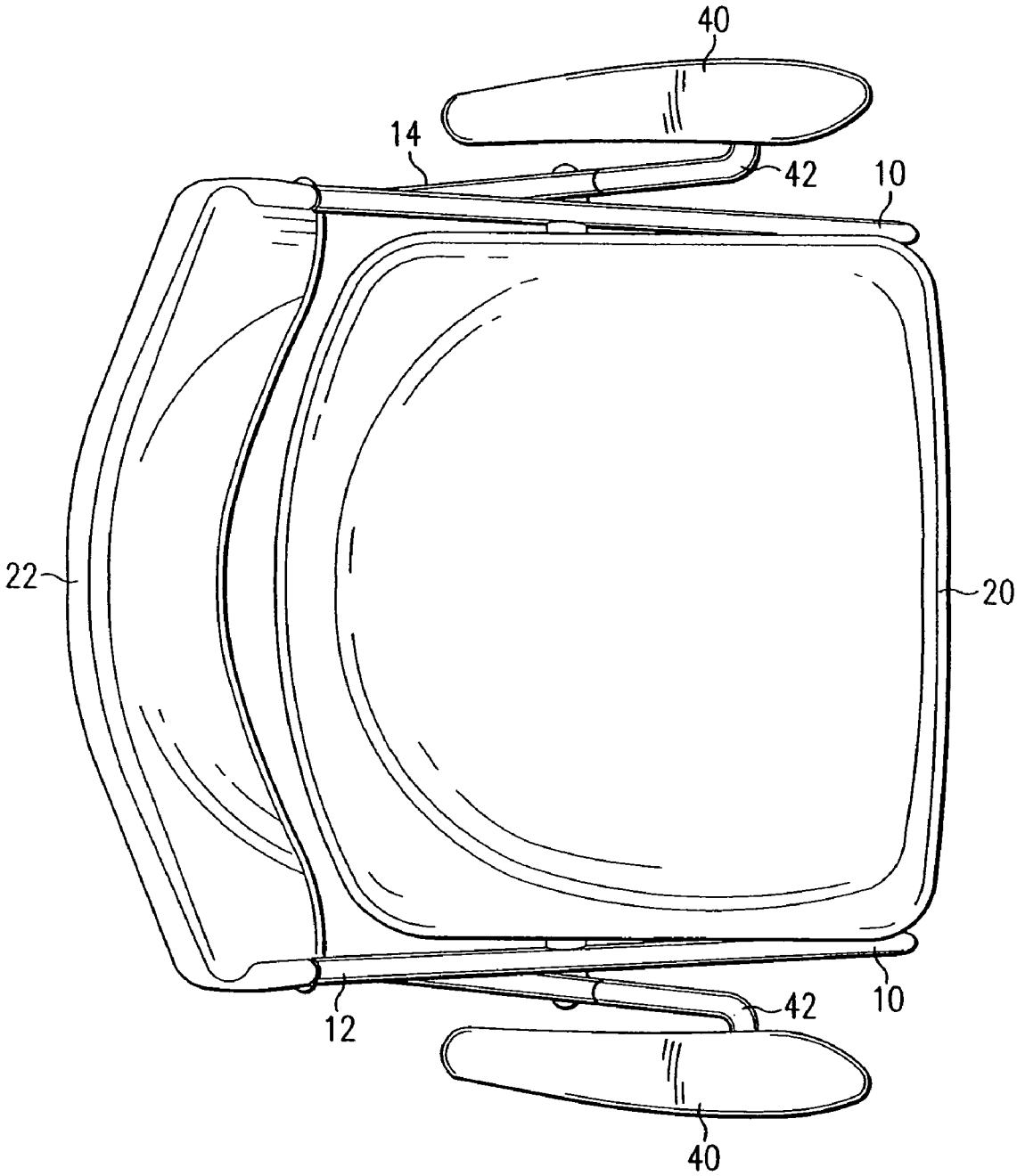
FIG. 4 is a top pictorial view of the embodiment.
Figure 5:
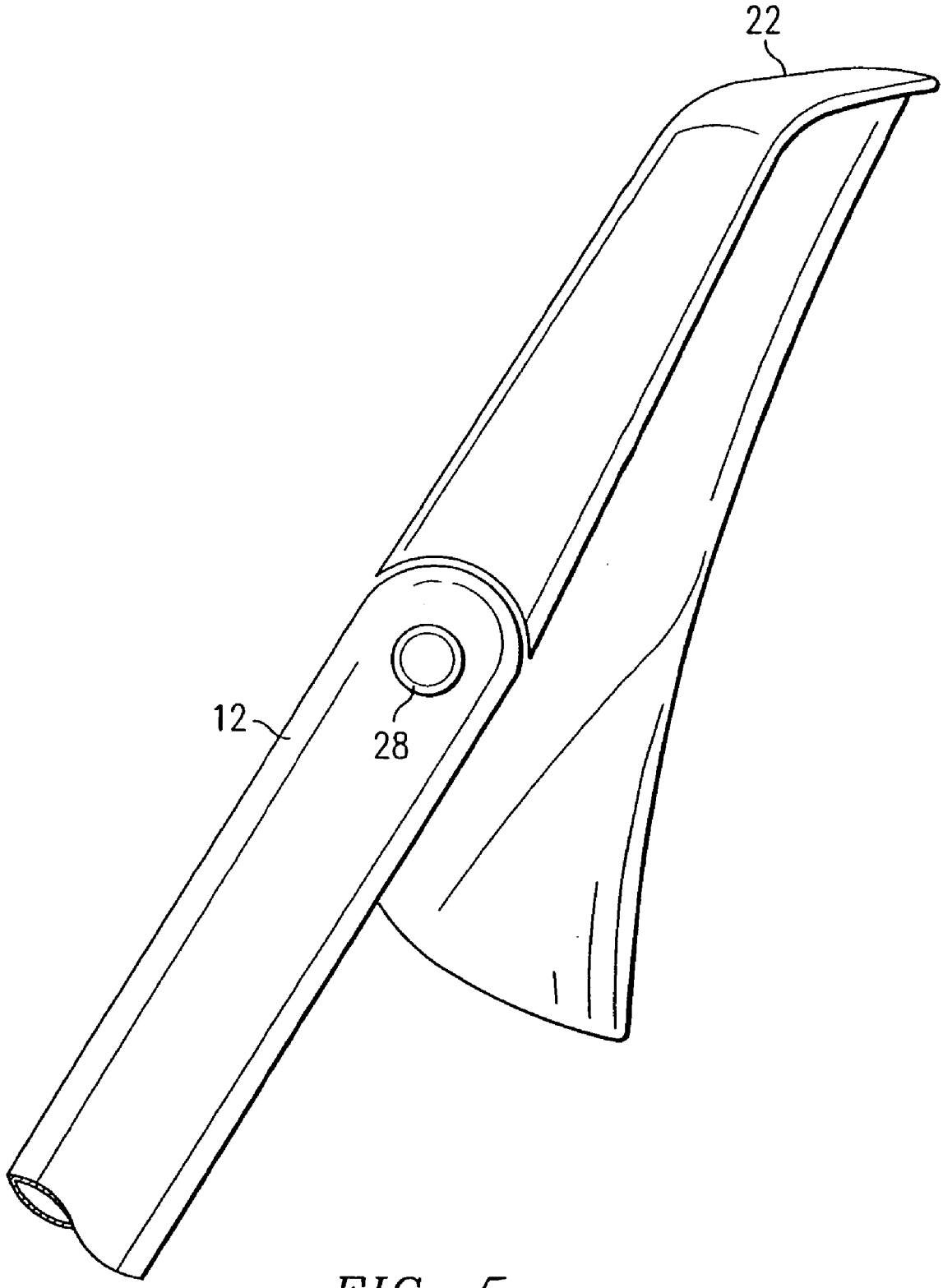
FIG. 5 is a partial side elevational view of the upper portion of the chair.
Figure 7:
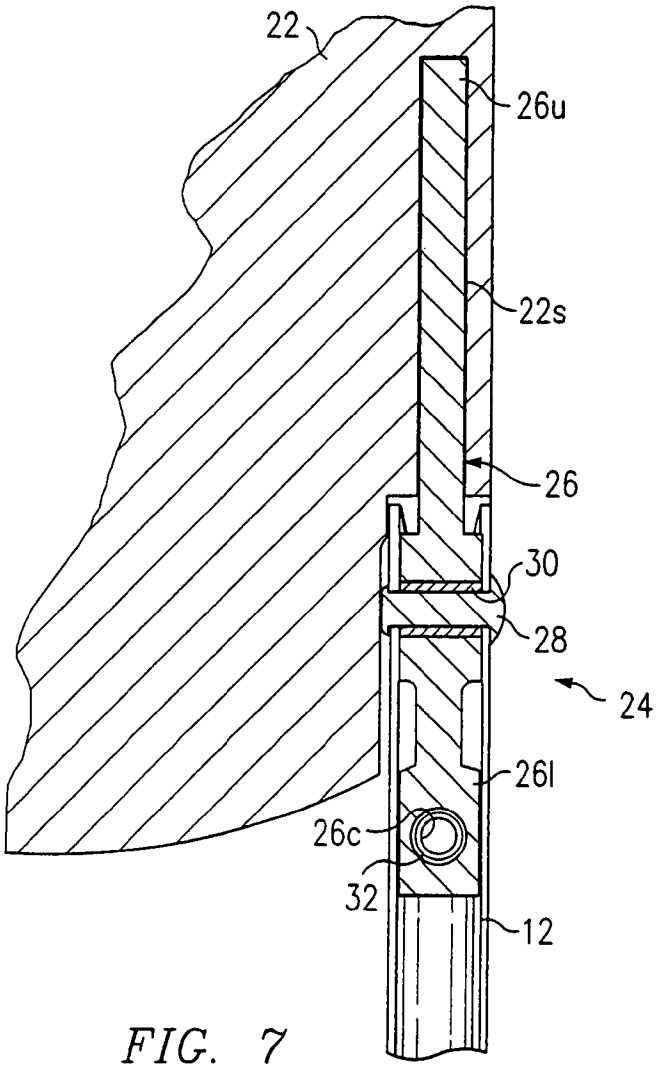
FIG. 7 is a partial front sectional view of the upper part of the chair.
Figure 6:
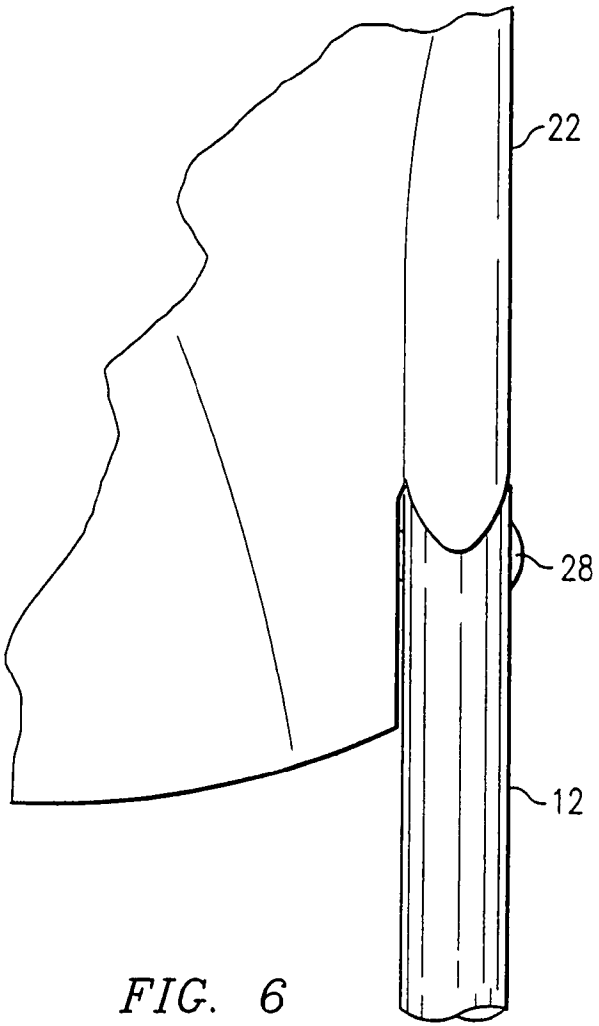
FIG. 6 is a partial front elevational view of the upper part of the chair.
Figure 9:
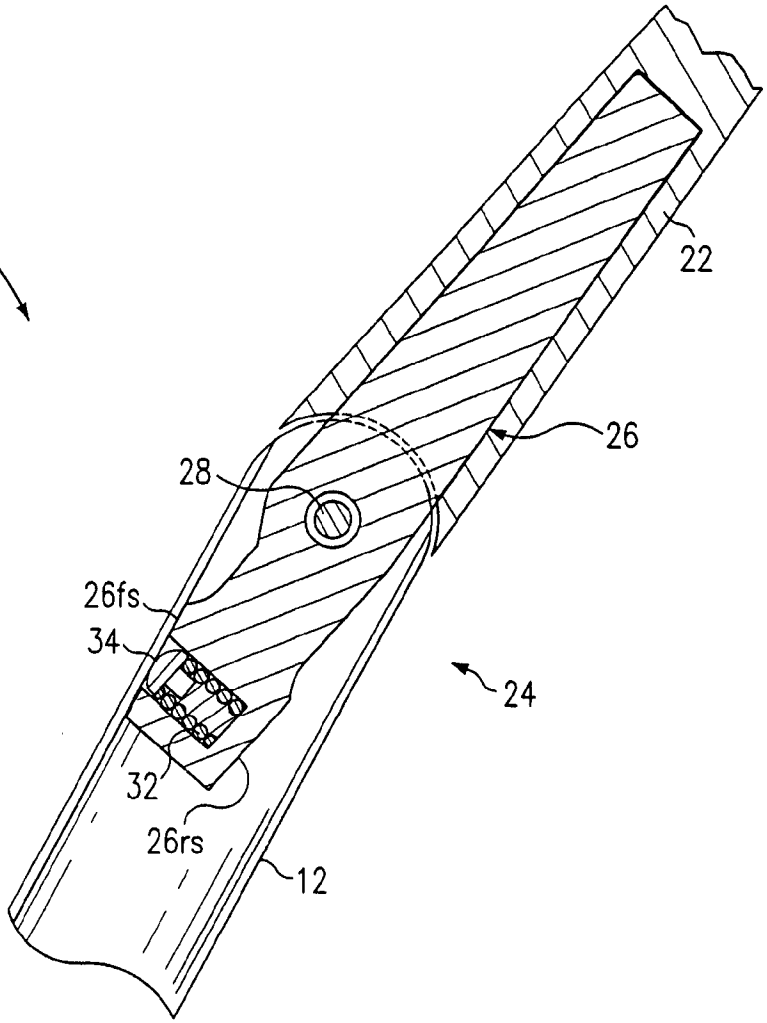
FIG. 9 is a partial side cross-sectional view of the upper part of the chair, showing the backrest in the tilted back position.

The embodiment shown in the drawings is a stackable institutional chair and in the version shown has armrest supports and armrests. The frame, which has a pair of front legs 10, a backrest support 12 unitary with each front leg, a pair of rear legs 14 and a cross beam 16, is fabricated from steel tubing and is of welded construction. Seat supports 18 are welded to the cross beam. A seat 20 of molded polymeric material or formed of a composite material is fastened to the seat supports. A backrest 22 of molded polymeric material or formed of a composite material is mounted on the backrest supports 12 by mount units 24 (FIGS. 5 to 9), which as described below allow the backrest to tilt rearwardly from an upright position to a tilted-back position. When the optional armrest supports and armrests are omitted, the open upper ends of the rear legs 14 are closed by plugs (not shown).

There is a mount unit 24 on each side of the chair—the two mount units are identical (except for the direction of insertion of the pivot pin). Each includes a rigid coupling member 26 having a lower portion 261 received within an upper end portion of the respective back support 12. The coupling member is pivotally joined to the back support 12 by a pivot pin 28 in the form of a rivet that passes through a hole in the coupling member and holes in walls of the back support 12. A tubular bushing 30 interposed between the pivot pin and the coupling member facilitates pivotal motion of the coupling member and serves as a spacer to keep the walls of the tubular backrest support 12 from being deformed by the pivot pin/rivet. The upper portion 26*u* of the coupling member 26 is received within and suitably affixed to a socket 22*s* in the backrest 22.

Figure 8:
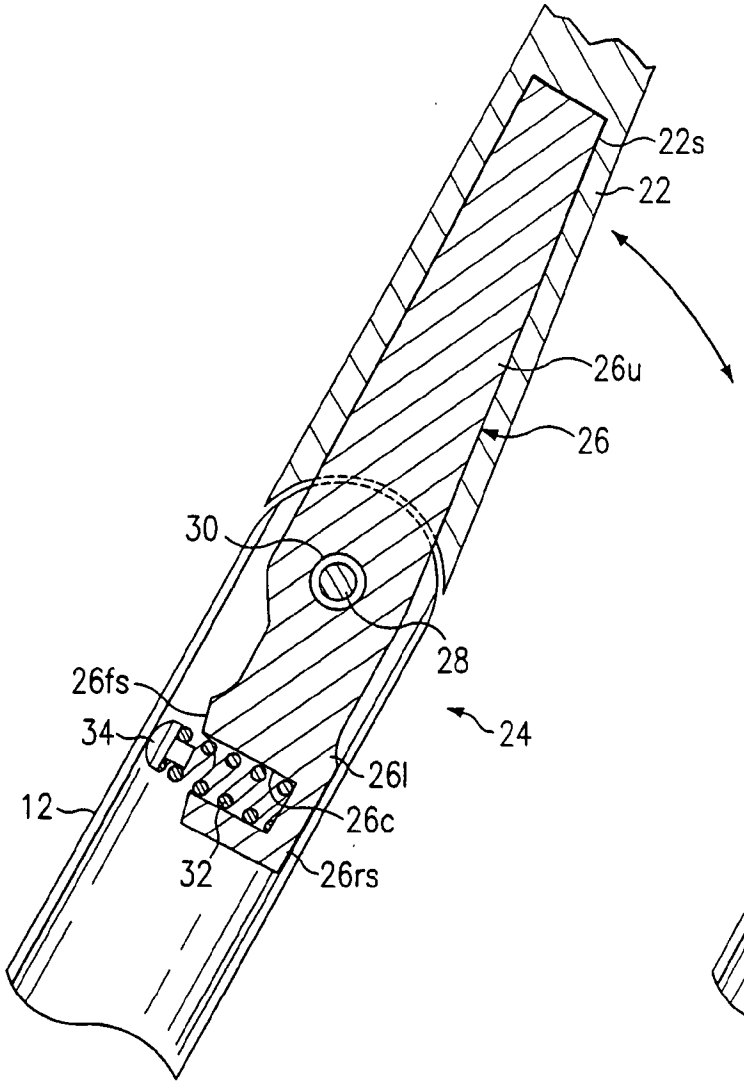
FIG. 8 is a partial side cross-sectional view of the upper part of the chair, showing the backrest in the upright position.
Figure 10:
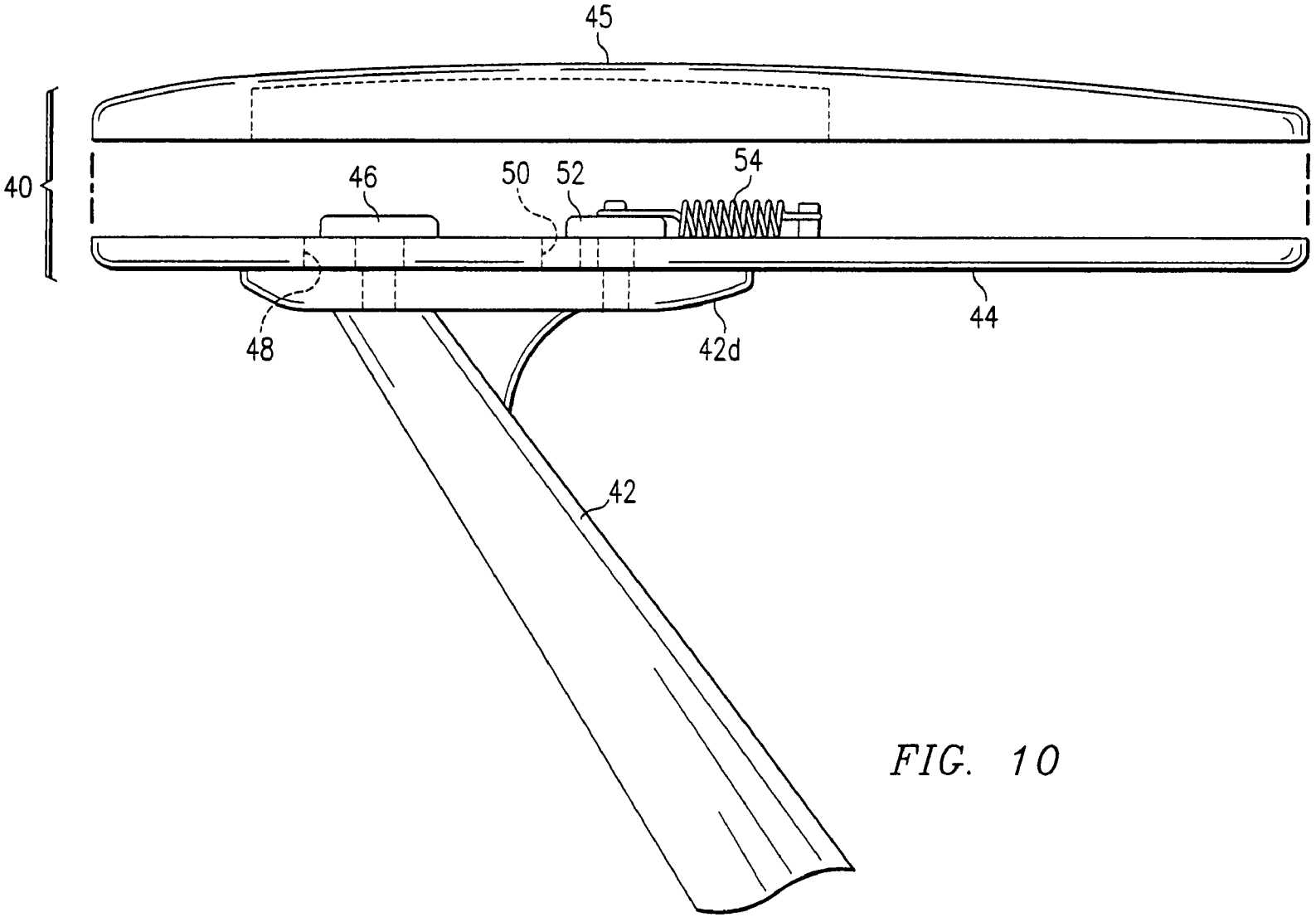
FIG. 10 is an exploded side elevational view of an armrest support and armrest of the embodiment.
Figure 11:
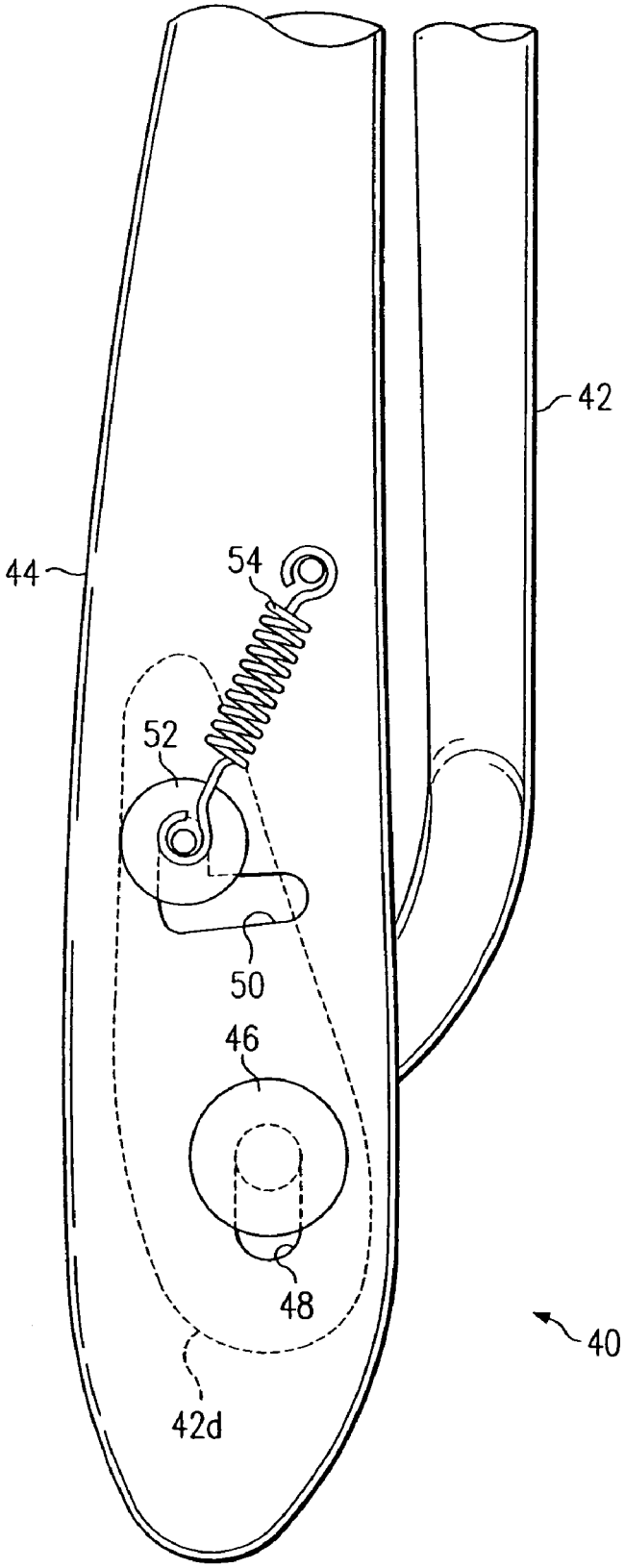
FIG. 11 is a partial top plan view of the armrest and the armrest support, showing the pad of the armrest removed.

A compression spring 32 received within the upper end portion of the back support 12 and engaged between the lower portion 261 of the coupling member 26 and a front wall of the respective back support 12 biases the backrest to the upright position (see FIG. 8). The spring 32 is seated in a cavity 26*c* in the lower portion 261 of the coupling member 26. A low friction pad 34 that is engaged between the spring 32 and the front wall of the back support facilitates sliding, reduces wear and quiets the operation of the backrest mount unit 24. A rear stop surface 26*rs* on the lower portion 26*j* of the coupling member engages a portion of the rear wall of the backrest support 12 when the backrest is in the upright position and stops the spring 32 from pivoting the backrest beyond the desired upright position.

When the person sitting in the chair leans back and applies a force to the backrest sufficient to overcome the biasing forces of the springs 28, the backrest tilts rearwardly. The ability of the person sitting in the chair to change his or her sitting position and to enjoy comfortable support of his or her anatomical back in a range of sitting postures reduces fatigue. The lower portion 261 of the coupling member 26 of each mount unit 24 includes a front stop surface 26*fs* that engages a portion of the front wall of the backrest support 12 when the backrest 22 has attained a maximum desired extent of rearward tilting.

The reader should note that the upper ends of the backrest supports 12 and the lower ends of the sides of the backrest 26 have complementary circular cylindrical surfaces, the centers of which coincide with the center axis of the pivot pin 28. Also, the mount units 24 are almost completely concealed—only the heads of the pivot pins/rivets are visible.

The optional armrests 40 of the chair are mounted on armrest supports 42. The supports 42 are aluminum castings and have lugs (not shown) at their lower ends that fit into the upper ends of the rear legs 14 and are suitable secured. A base member 44 of the armrest 40 rests on a planar upper surface of a deck portion 40*d* of each armrest support 40. As will be apparent after the description below has been read, a pad 45 of the armrest is installed on the base member 44 after the other components of the armrest support and armrest have been assembled.

Figure 14:
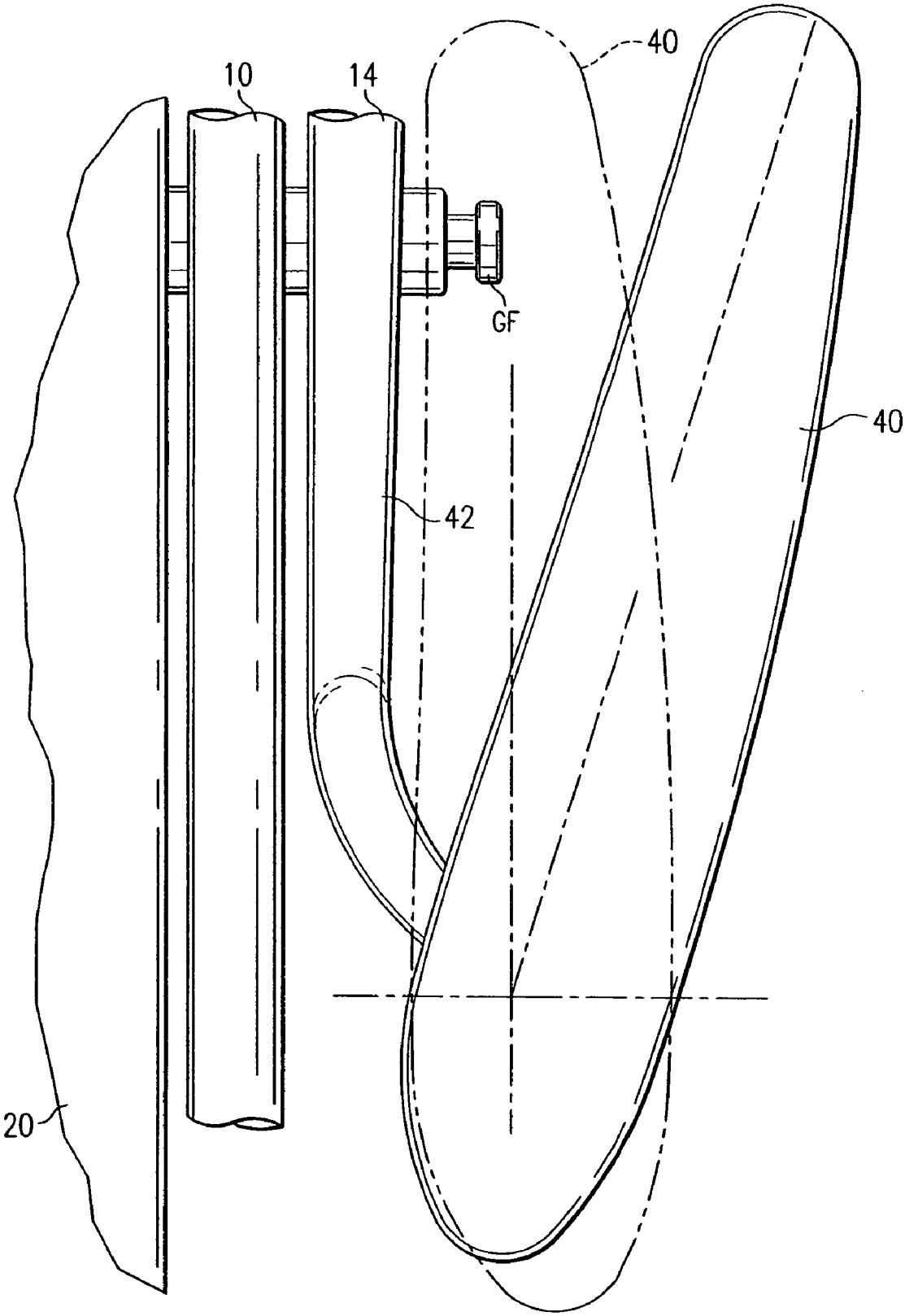
FIG. 14 is a schematic top plan view of the armrest and part of the armrest support, showing the armrest in the use position in phantom lines and in the storage position in solid lines.

The base member 44 of the armrest is slidably supported on the deck portion 42*d* of the armrest support for simultaneous and controlled pivotal movement about a substantially vertical pivot axis of a rearward part of the armrest relative to a forward part of the armrest and translatory movement in a plane perpendicular to the pivot axis. In particular, each armrest is mounted on the arm rest support so that it can be moved between a use position, which is shown in phantom lines in FIG. 14, and a storage position, which is shown in solid lines in FIG. 14. In the use position the rearward part of the armrest is closer to the center of the seat bottom than it is when the armrest is in the storage position. The ability to move the armrests from the us positions to the storage positions prevents the ganging fittings GF (FIG. 14) on the chairs from being blocked by the armrests and permits the ganging fitting of each upper chair in a stack to pass freely and readily by the armrests of the chairs below it in the stack.

Figure 12:
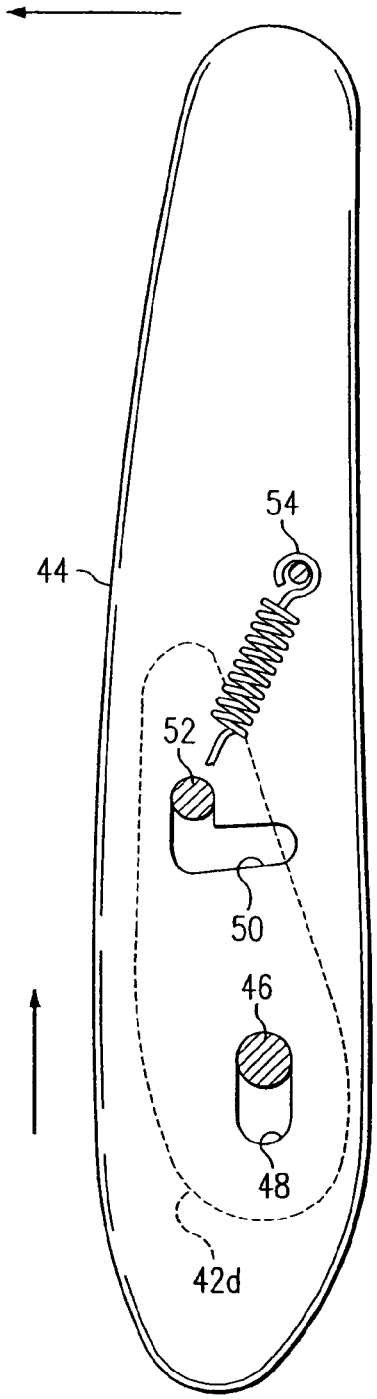
FIG. 12 is a schematic top plan view of the armrest and part of the armrest support, showing the armrest in the use position.

The armrest 40 is mounted on the armrest support 42 for pivotal movement by a pivot pin 46 that is affixed to the deck portion 42*d* of the armrest support and is received in an elongated slot 48 in the base member 44 of the armrest such that the armrest is able to translate relative to the armrest support. An L-shaped motion control slot 50 in the base member 44 receives a control pin 52 that is affixed to the deck portion 44 of the armrest support. The motion control slot 50 controls the extent and path of movement of the armrest relative to the armrest support between the use position and the storage position. A tension spring 54 connected between the armrest base member 44 and the control pin 52 biases the armrest forwardly, a position in which the armrest is retained by coaction between the control slot 50 and the control pin 52 (FIG. 12). Ordinarily, the person sitting in the chair is unaware of the fact that the armrest is movable.

Figure 13:
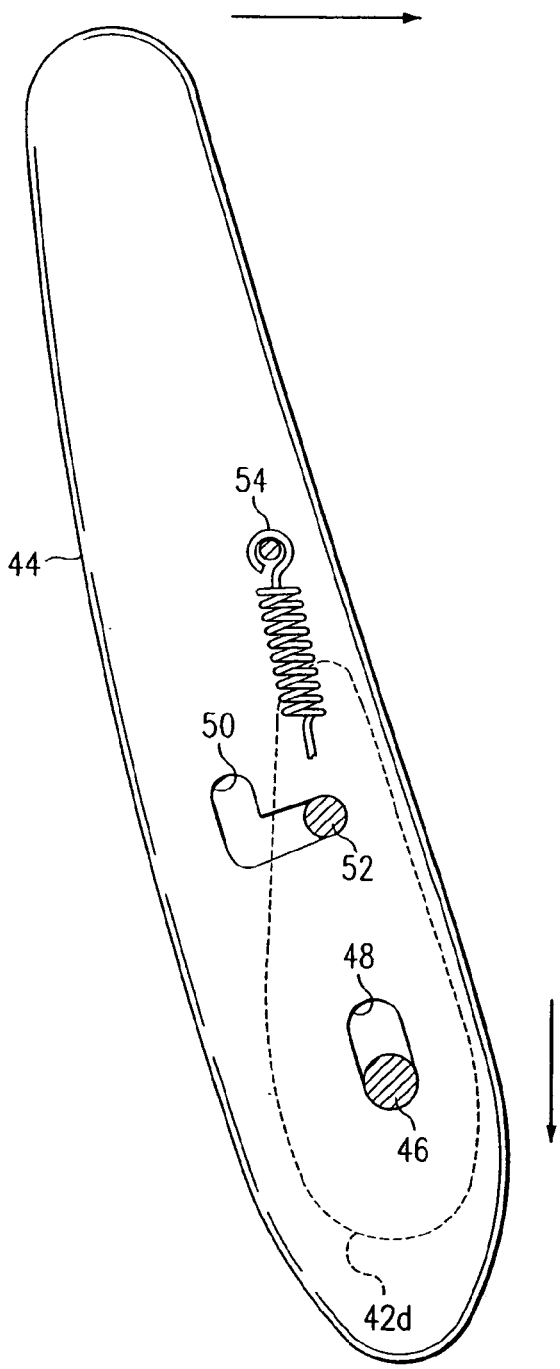
FIG. 13 is a schematic top plan view of the armrest and part of the armrest support, showing the armrest in the stored position.

When the chair is to be stored, the worker grasps the armrest and pushes it rearwardly relative to the armrest support. The armrest slides rearwardly relative to the support against the bias of the spring 54 until the pin 52 contacts the front edge of the slot 50. The worker then pivots the back part of the arm outwardly away from the seat, thus bringing the armrest to the storage position shown in FIG. 13. Friction forces hold the armrest in the storage position until someone pushes the rearward part of the armrest toward the chair seat. The spring 54 can then move the armrest back to the use position.

What is claimed is:

1. A stackable chair comprising a frame that includes legs and a pair of spaced-apart tubular back supports, a seat bottom mounted on the legs, and a backrest mounted on the back supports by resilient mount units for tilting between an upright position and a tilted-back position, characterized in that each mount unit includes a rigid coupling member having a lower portion received within an upper end portion of the respective back support and pivotally joined to the respective back support and having an upper portion received within and affixed to a socket in the backrest and in that each mount unit further includes a compression spring received within the upper end portion of the back support and engaged between the lower portion of the coupling member and a front wall of the respective back support so as to bias the backrest to the upright position.

2. The stackable chair according to claim 1, wherein the lower portion of the coupling member of each mount unit includes a cavity in which a portion of the compression spring is received.

3. The stackable chair according to claim 1, wherein the compression spring carries a low friction pad that is engaged between the spring and the front wall of the back support.

4. The stackable chair according to claim 1, wherein the coupling member of each mount unit is pivotally joined to the respective back support by a pivot pin that passes through a hole in the coupling member and holes in walls of the back support.

5. The stackable chair according to claim 1, wherein the lower portion of the coupling member of each mount unit includes a rear stop surface that engages a portion of the wall of the backrest support when the backrest is in the upright position.

6. The stackable chair according to claim 1, wherein the lower portion of the coupling member of each mount unit includes a front stop surface that engages a portion of the wall of the backrest support when the backrest is in the tilted-back position.

7. The stackable chair according to claim 1, wherein the lower portion of the coupling member of each mount includes a rear stop surface that engages a portion of the wall of the backrest support when the backrest is in the upright position and a front stop surface that engages a portion of the wall of the backrest support when the backrest is in the tilted-back position.

8. The stackable chair according to claim 1, wherein there is an armrest support associated with the frame and an armrest is mounted on the armrest support, characterized in that the armrest is slidably supported on the armrest support for simultaneous and controlled pivotal movement about a substantially vertical pivot axis of a rearward part of the armrest relative to a forward part of the armrest and translatory movement in a plane perpendicular to the pivot axis.

9. The stackable chair according to claim 8, wherein the armrest is biased to a use position and is pivotable and translatable against the bias to a storage position and in that when the armrest is in the use position the rearward part of the armrest is closer to the center of the seat bottom than it is when the armrest is in the storage position.

10. The stackable chair according to claim 9, wherein the armrest support has a substantially flat support surface, the arm rest is mounted on the armrest support for pivotal movement by a pivot pin that is affixed to the armrest support, and the pivot pin is received in an elongated slot in the armrest such that the armrest is able to translate relative to the armrest support.

11. The stackable chair according to claim 10, wherein the armrest has a motion control slot, a control pin is affixed to the armrest support and is received in the motion control slot, and the motion control slot is configured to control the extent and path of movement of the armrest relative to the armrest support.

12. The stackable chair according to claim 11, wherein the motion control slot is shaped and located such that the armrest is selectively retained in the use position and the storage position under the bias of the spring.

13. The stackable chair according to claim 12, wherein the motion control slot is generally L-shaped in plan.

14. A stackable chair comprising a frame that includes legs and a pair of spaced-apart back supports, a seat bottom mounted on the legs, a backrest mounted on the back supports, an armrest support associated with the frame and an armrest mounted on the armrest support, characterized in that the armrest is slidably supported on the armrest support for simultaneous and controlled pivotal movement about a substantially vertical pivot axis of a rearward part of the armrest relative to a forward part of the armrest and translatory movement in a plane perpendicular to the pivot axis.

15. The stackable chair according to claim 14, wherein the armrest is biased to a use position and is pivotable and translatable against the bias to a storage position and in that when the armrest is in the use position the rearward part of the armrest is closer to the center of the seat bottom than it is when the armrest is in the storage position.

16. The stackable chair according to claim 15, wherein the armrest support has a substantially flat support surface, the arm rest is mounted on the armrest support for pivotal movement by a pivot pin that is affixed to the armrest support, and the pivot pin is received in an elongated slot in the armrest such that the armrest is able to translate relative to the armrest support.

17. The stackable chair according to claim 16, wherein the armrest has a motion control slot, a control pin is affixed to the armrest support and is received in the motion control slot, and the motion control slot is configured to control the extent and path of movement of the armrest relative to the armrest support.

18. The stackable chair according to claim 17, wherein the motion control slot is shaped and located such that the armrest is selectively retained in the use position and the storage position under the bias of the spring.

19. The stackable chair according to claim 18, wherein the motion control slot is generally L-shaped in plan.

* * * * *